United States Patent [19]

Borio et al.

[11] 4,300,459

[45] Nov. 17, 1981

[54] CHAR BINDER FOR FLUIDIZED BEDS

[75] Inventors: Richard W. Borio, Somers; Joseph I. Accortt, Simsbury, both of Conn.

[73] Assignee: Combustion Engineering, Inc., Windsor, Conn.

[21] Appl. No.: 174,764

[22] Filed: Aug. 4, 1980

[51] Int. Cl.[3] ..... F23D 1/00

[52] U.S. Cl. ..... 110/263; 110/245; 110/347; 122/4 D

[58] Field of Search ..... 110/263, 264, 245, 347; 122/4 D

[56] References Cited

U.S. PATENT DOCUMENTS

| | | | |
|---|---|---|---|
| 3,763,830 | 10/1973 | Robinson et al. | 110/264 X |
| 4,085,707 | 4/1978 | Nauss | 110/263 X |
| 4,103,646 | 8/1978 | Yerushalmi | 110/263 X |
| 4,177,741 | 12/1979 | Stewart et al. | 110/263 |
| 4,259,911 | 4/1981 | Jones | 110/263 |

*Primary Examiner*—Edward G. Favors

*Attorney, Agent, or Firm*—Wayne H. Lang

[57] ABSTRACT

An arrangement that utilizes agglomerating coal as a binder to bond coal fines and recycled char into an agglomerate mass that will have suitable retention time when introduced into a fluidized bed 14 for combustion. The simultaneous use of coal for a primary fuel and as a binder effects significant savings in the elimination of non-essential materials and processing steps.

1 Claim, 1 Drawing Figure

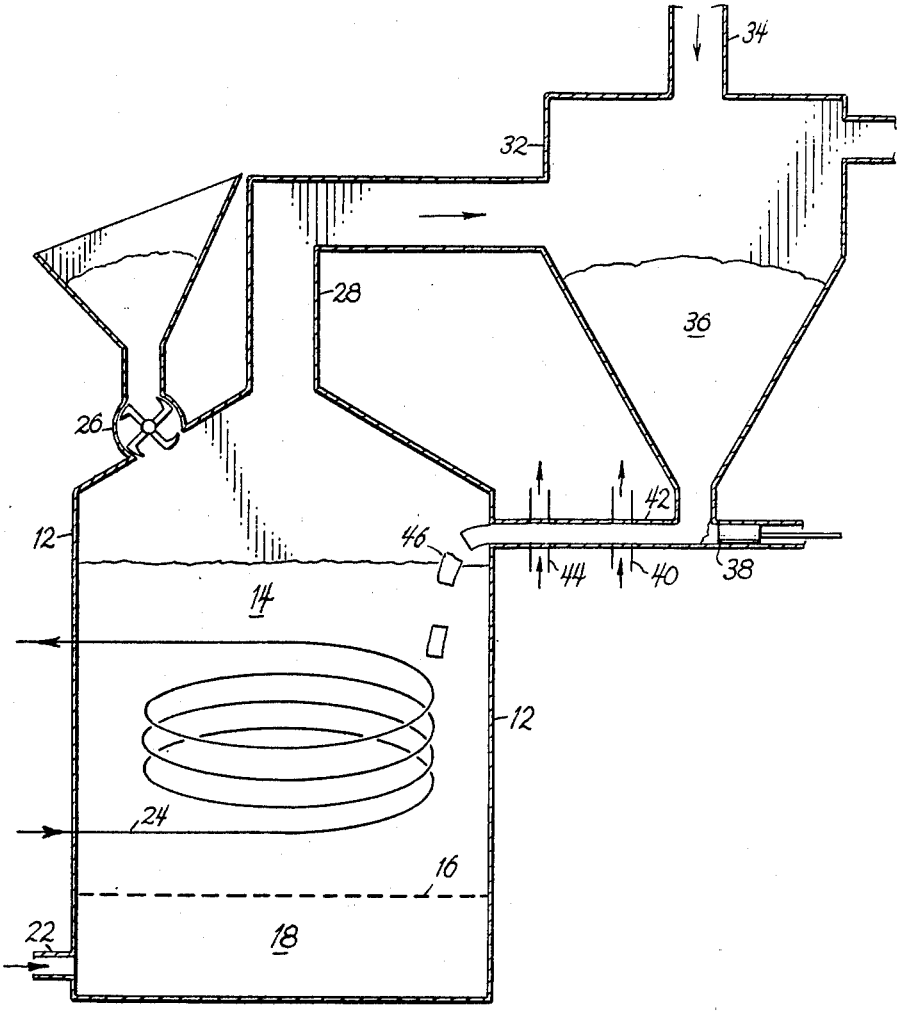
34
32
28
36
26
42
12
46
44
40
38
14
12
24
16
22
18

CHAR BINDER FOR FLUIDIZED BEDS

The Government of the United States of America has rights in this invention pursuant to contract No. E-76-C-01-2473 awarded by the U.S. Department of Energy.

BACKGROUND OF THE INVENTION

This invention relates to fluidized bed type reactors used for the combustion of crushed coal in industrial or utility type applications.

The combustion of crushed coal in a fluidized bed is dependent upon the temperature of the bed, maintaining sufficient oxygen for combustion, and the retention time, i.e., holding the particles of fuel in the bed for a time sufficient to attain a temperature that effects combustion. The retention time for fuel particles in the bed is chiefly a function of their size, the large particles remaining in the bed to effect combustion while small particles called "fines" are quickly ejected therefrom as partially burned "char. " The exact boundary between "fines" and the larger particles is a function of the superficial velocity in the bed. If the small particles of coal and char could be agglomerated or fused into larger particles and again injected into the combustion bed, their residence time or retention there would necessarily increase and the efficiency of combustion would also increase accordingly.

It is known that a mixture of coal fines and char may be compressed into larger particles or chunks that when burned in a fluidized bed will be retained therein for a time sufficient to effect complete combustion. A specific binding agent such as bentonite is frequently added directly to the fines before they are compressed, whereby the compacted mass resulting therefrom will be held in the fluidized bed until combustion is complete.

This type of operation may prove to be highly effective, but it does require additional material at an additional cost, and it frequently requires further steps of material preparation and waste disposal.

It has been found that certain types of medium and highly volatile bituminous (agglomerating) coals go through a plastic stage during a heating process to thereby reduce the surface area and reactivity of the coal and also increase its tendency toward agglomeration. The present invention accordingly requires that unburned carbon and char leaving a fluidized bed be collected downstream from the bed and mixed with crushed agglomerating type coal before it is compressed into large chunks and directed back into the fluid bed to thereby increase its retention time during the combustion process.

SUMMARY OF THE INVENTION

More specifically, the present invention relates to apparatus for burning agglomerating type coals wherein the coal itself is employed as a binding medium for the agglomeration of recycled char fines. Crushed coal feed and char fines are thoroughly mixed before they are compressed into large plastic chunks of fuel. These chunks may be heated to improve their tendency to agglomerate, but no supplemental binder is required to fuse them into an integral mass.

BRIEF DESCRIPTION OF THE DRAWING

The invention will be more clearly understood from the following description read in conjunction with the accompanying drawing in which the only FIGURE is a schematic side elevation of a system that includes the features of the present invention.

DESCRIPTION OF THE INVENTION

In the drawings a fluidized bed type reactor including a housing 12 encloses a bed of crushed coal and limestone 14 that is supported on a horizontally disposed screen or perforated plate 16 to provide a plenum chamber 18 for combustion air that enters the housing through an inlet 22. The inlet air flows upwardly through the interstices of plate 16 and into the free area between particles of the crushed material to support combustion of the coal. Heat from the fluidized bed is then absorbed therefrom by fluid flowing, for example, through coils 24 immersed in the fluid bed.

Crushed subbituminous coal, anthracite coal and coke fines alone or in combination may be added to the fuel bed 14 through feeder 26 and then subjected to combustion. As the fuel bed is subjected to combustion, products of combustion given off include a quantity of unburned char which is exhausted through duct 28 to collector 32. The collected char is subsequently mixed with a quantity of volatile agglomerating coal as admitted through inlet 34, and the unburned mixture of agglomerating coal and char then collected to provide an accumulation bed 36 of this mixture. In the case where an agglomerating bituminous coal is the prime fuel, the unburned carbon/char fines could be mixed with a portion of the prime fuel.

Subjacent collector 32 and in communication with bed 36 is a compacting means shown schematically at 38. The compacting means 38 is adapted to receive the coal-char mixture from the bed 36 and compress it into larger particles or chunks. The large chunks of agglomerated coal and char then pass through a steam heater 40 where they are heated to achieve maximum binding characteristics, and then through passageway 42 to a cooler 44 where the agglomerated mass is "frozen" to form chunks 46 when added to bed 14.

It has been observed that most agglomerating coals go through a stage of maximum plasticity at from 480° F. to 840° F. Accordingly, the steam heater 40 is adapted to maintain this temperature range whereby the particulate char and the crushed agglomerating coal are effectively fused together into a large mass that will not quickly break down into fine particles when admitted to the fluidized bed 14. As a result, the retention time of fused fines in bed 14 is increased, combustion is essentially complete and the overall effectiveness of the operation is greatly enhanced.

We claim:

1. A fluidized bed type reactor having a housing enclosing a combustion chamber for the combustion of crushed fuel that includes a quantity of particulate fines, a collection chamber adapted to receive unburned particulate char exhausted from the combustion chamber, means supplying a quantity of crushed coal to the collection chamber, means for mixing together the particulate char and crushed coal, compacting means intermediate the collection chamber and the combustion chamber adapted to compress the crushed coal and particulate char into an agglomerate mass, means for delivering the agglomerate mass of fuel and char to the fluid bed in the combustion chamber, and means for cooling the agglomerated mass of crushed coal and char intermediate the heating means and the combustion chamber whereby the agglomerated mass is solidified before being introduced into the combustion chamber.

* * * * *